US007755040B2

(12) United States Patent
Li et al.

(10) Patent No.: US 7,755,040 B2
(45) Date of Patent: Jul. 13, 2010

(54) MASS SPECTROMETER AND ELECTRIC FIELD SOURCE FOR MASS SPECTROMETER

(75) Inventors: Gangqiang Li, Palo Alto, CA (US); Alexander Mordehai, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 308 days.

(21) Appl. No.: 11/860,263

(22) Filed: Sep. 24, 2007

(65) Prior Publication Data

US 2009/0078866 A1 Mar. 26, 2009

(51) Int. Cl.
*H01J 49/00* (2006.01)

(52) U.S. Cl. ..... 250/297; 250/281; 250/282; 250/294; 250/295; 250/296; 250/298

(58) Field of Classification Search ..... 250/281, 250/282, 294, 295, 296, 297, 298
See application file for complete search history.

(56) References Cited

U.S. PATENT DOCUMENTS

2005/0121609 A1* 6/2005 Makarov et al. ..... 250/290
2006/0027746 A1* 2/2006 Guevremont et al. ..... 250/292
2006/0086896 A1* 4/2006 Han ..... 250/221
2006/0219889 A1* 10/2006 Shvartsburg et al. ..... 250/282

* cited by examiner

*Primary Examiner*—Jack I Berman
*Assistant Examiner*—Hanway Chang

(57) ABSTRACT

An electric field source for a mass spectrometer and a mass spectrometer are described.

21 Claims, 8 Drawing Sheets

400

MASS SPECTROMETER AND ELECTRIC FIELD SOURCE FOR MASS SPECTROMETER

BACKGROUND

Mass spectrometers are used in a wide variety of applications. For example, mass spectrometers are used to analyze organic materials, such as pharmaceutical compounds, environmental compounds and biomolecules. Mass spectrometers have found particular applicability in DNA and protein sequencing. In these and other applications there is an ever-increasing demand for mass accuracy, as well as comparatively high resolution of analysis of sample ions by the mass spectrometer.

Time-of-flight mass spectrometry (TOFMS) involves accelerating ions through the same potential using an electric field. The TOFMS then measures the time of travel (i.e., flight in the electric field) of the ions to a detector. If the ions are of the same charge, their kinetic energy is the same and their velocities depend on their mass. Thus, the particles of differing masses may be resolved based solely on their velocity and hence, their time of flight. TOFMS devices have a resolving power on the order of $10^3$ to $10^4$. However, in many applications a higher resolving power is desirable.

Fourier transform ion cyclotron resonance (FTICR) MS, measures mass by detecting the image current produced by ions cyclotroning in the presence of a magnetic field. Instead of measuring the deflection of ions with a detector such as an electron multiplier, the ions are injected into a Penning trap (a static electric/magnetic ion trap) where they effectively form part of a circuit. Detectors at fixed positions in space measure the electrical signal of ions which pass near them over time producing cyclical signal. Since the frequency of an ion's cycling is determined by its mass-to-charge ratio, the frequency can be deconvoluted by performing a Fourier transform on the signal. FTICR MS has the advantage of high sensitivity (since each ion is 'counted' more than once) and much high resolution and thus precision FTICR mass spectrometer provides a comparatively high resolving power (on the order of $10^6$).

While FTICR MS provides comparatively high resolving power, these types of mass spectrometers are comparatively complex, large and expensive. Notably, FTICR MS devices require a rather large magnetic field and magnetic. These magnets may be superconducting magnets requiring sufficient cooling to achieve and maintain superconducting conditions. As such, not only is the size and complexity of the FTICR MS great, the capital and operating costs are often high. Alone of in combination, these factors render the FTICR MS impractical in many applications.

Another type of mass spectrometer that has garnered attention recently is known as an orbitrap. In a known orbitrap, ions are electrostatically trapped in an orbit around a central, spindle-shaped electrode. The electrode confines the ions so that they both orbit around the central electrode and oscillate back and forth along the central electrode's long axis. This oscillation generates an image current in the detector plates which is recorded by the instrument. The frequencies of these image currents depend on the mass to charge ratios of the ions in the orbitrap. Mass spectra are obtained by Fourier transformation of the recorded image currents.

Like FTICR MS devices, orbitraps have a comparatively high mass accuracy, a comparatively high sensitivity and a good dynamic range. However, unlike the FTICR MS, the orbitrap does not require a large magnet and ancillary equipment.

While promising, known orbitraps normally comprise machined components to generate the electric fields for the trap. Once made, these components cannot be easily altered or tuned after fabrication. As such, if there are manufacturing inconsistencies or flaws, for example, little relief is available and the manufacturing yields are adversely impacted. Moreover, if the geometry of the machined pieces is flawed the electric field may be irreparably flawed. This results in poor performance.

In addition to the noted shortcomings of known orbitraps, ion injection can be rather difficult. In particular, in known orbitraps, the outer conductor has tapered ends and is maintained at a particular voltage, which may be rather large. Ions injected into the orbitrap from the tapered ends can be ejected by the large field created by the outer conductor. Thus, many known orbitraps require elaborate ion optics and ion injectors to introduce the ions into the trap effectively. Clearly, these injection facilitating devices can be costly and can add to the complexity of the orbitrap MS.

There is a need, therefore, for resonator structure and filter that overcomes at least the shortcoming of known optical encoders discussed above.

SUMMARY

In a representative embodiment, an electric field source for use in a mass spectrometer includes an inner electrode and an outer electrode concentric with the inner electrode. The outer electrode comprises electrically-isolated conductive segments arranged in tandem. The electric field source also includes a voltage source connected to the outer electrode and operative to apply a pattern of voltages to the conductive segments.

In another representative embodiment, a mass spectrometer is adapted to dynamically trap ions in an electrostatic field. The mass spectrometer includes an inner electrode and an outer electrode concentric with the inner electrode, the outer electrode comprising electrically-isolated conductive segments arranged in tandem. The mass spectrometer also includes a voltage source connected to the outer electrode and operative to apply a pattern of voltages to the conductive segments. Furthermore, the mass spectrometer comprises a spectrum processor adapted to receive signals from at least one of the plurality of conductive segments.

In another representative embodiment, an electric field source for use in a mass spectrometer includes an inner electrode comprising electrically-isolated conductive segments arranged in tandem. The electric field source also includes an outer electrode concentric with the inner electrode, the outer electrode comprising electrically-isolated conductive segments arranged in tandem. Furthermore, the electric field source includes a voltage source connected to the outer electrode, or to the inner electrode, or both, and is operative to apply a pattern of voltages to the conductive segments of the inner electrode, or the outer electrode, or both.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

As used herein, the terms 'a' or 'an' mean one or more.

DETAILED DESCRIPTION

In the following detailed description, for purposes of explanation and not limitation, representative embodiments disclosing specific details are set forth in order to provide a thorough understanding of the present teachings. Descriptions of known devices, materials and manufacturing methods may be omitted so as to avoid obscuring the description of the example embodiments. Nonetheless, such devices, materials and methods that are within the purview of one of ordinary skill in the art may be used in accordance with the representative embodiments.

The representative embodiments described herein relate to electric field sources for orbitrap spectrometers and orbitrap spectrometers. The electric field sources of the representative embodiments generate a 'substantially quadro-logarithmic electrical potential' in regions between electrodes. As will become clearer as the present description continues, although a 'true' quadro-logarithmic potential may be generated between the electrodes by the electric field source, the discontinuous nature of the segments of the electrodes can introduce anomalies in the electric field and thus the electrical potential, causing the potential to diverge somewhat from the 'true' quadro-logarithmic potential. As used herein, the term 'substantially quadro-logarithmic electrical potential' encompasses both the 'true' quadro-logarithmic electrical potential' and the electrical potential resulting from these anomalies. Furthermore, the application of the present teachings to generate other types of electric fields for use in spectrometry and in disparate arts is possible both now and in the future.

Figure 1A:
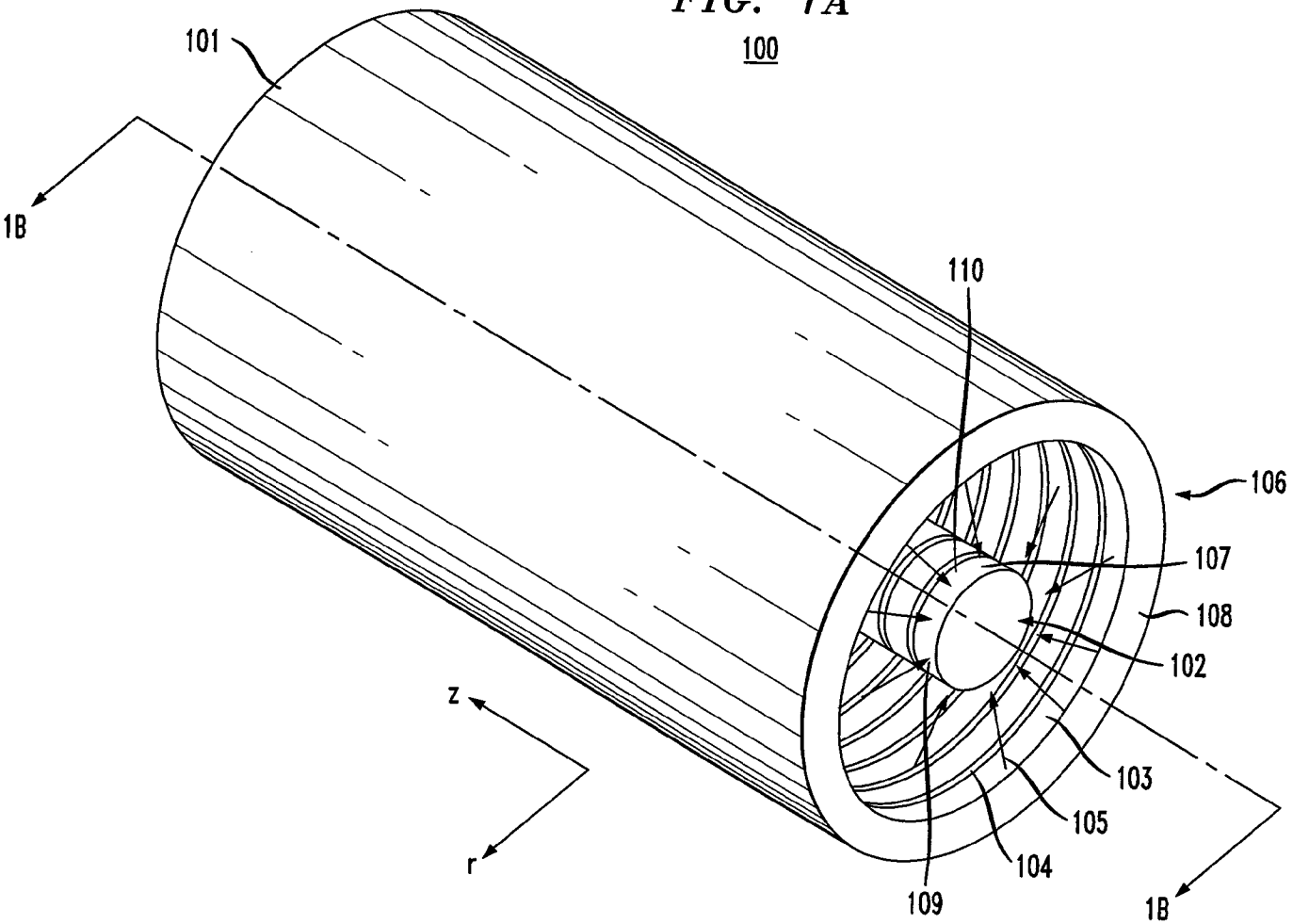
FIG. 1A is a perspective view of an electric field source for a mass spectrometer in accordance with a representative embodiment.

FIG. 1A is a perspective view of an electric field source 100 for a mass spectrometer in accordance with a representative embodiment. The source 100 comprises an outer electrode 101 and an inner electrode 102. The outer electrode 101 includes electrically-isolated conductive segments arranged 103 in tandem with spaces 104 therebetween. The spaces 104 provide electrical isolation for the segments 103.

In the present embodiment, the segments 103 are disposed over an inner surface 106 of a substrate 108 the outer electrode 101, and opposing electrically isolated conductive electrodes 110 disposed over an outer surface 107 of a substrate 109 of the inner electrode 102. As described more fully herein, application of voltage from a voltage source to segments of the outer electrode, or the inner electrode, or both, establishes an electric field 105 between the electrodes.

Figure 1B:
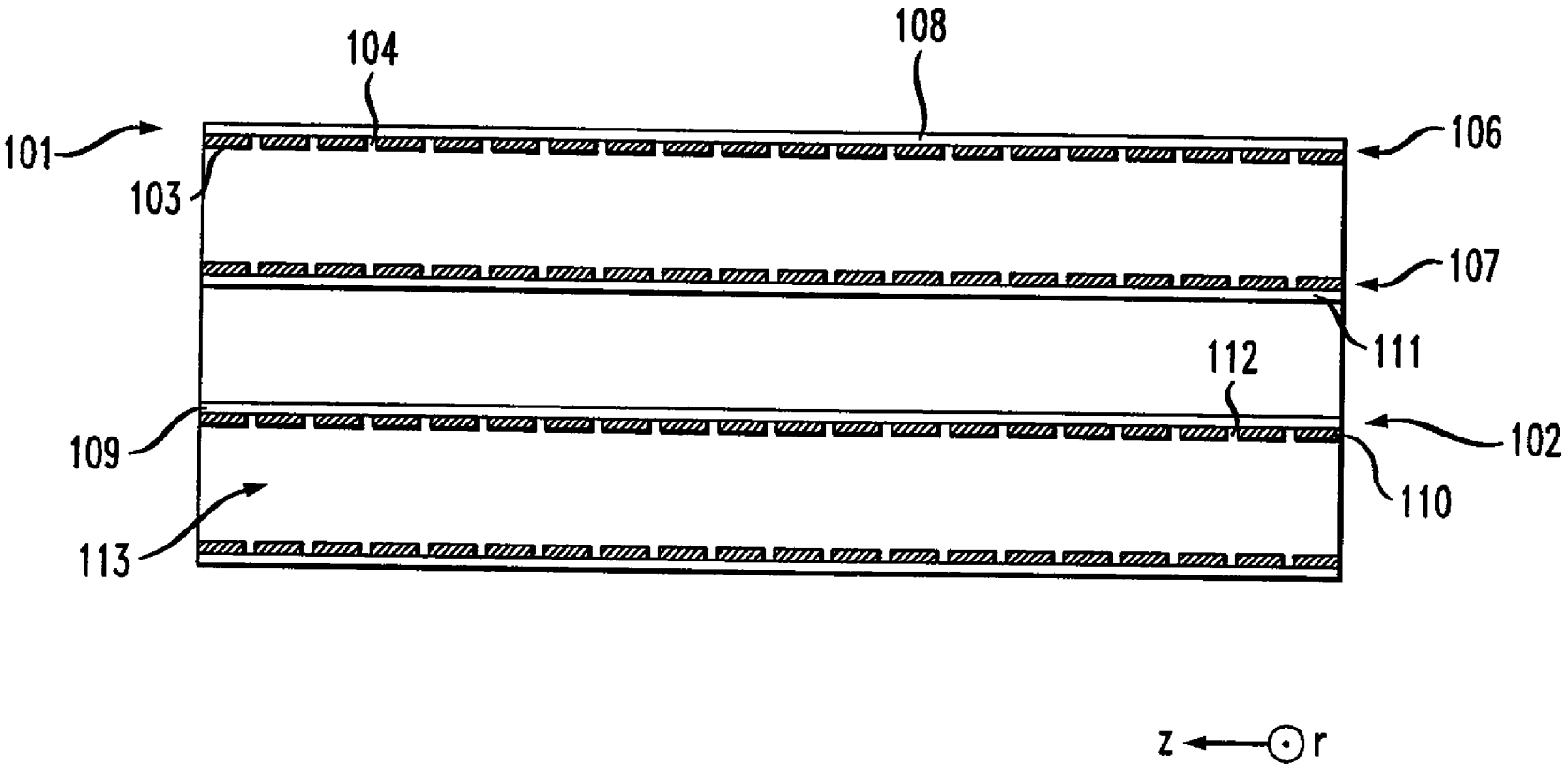
FIG. 1B is a cross-sectional view of the electric field source of the representative embodiment of FIG. 1A taken along the line 1B-1B.

FIG. 1B is a cross-sectional view of the electric field source 100 in accordance with a representative embodiment taken along the line 1B-1B. The present view shows the outer electrode 101 and the inner electrode 102 with conductive segments 110 disposed in tandem over an outer surface 107 of the inner electrode 102. The conductive segments 110 are separated by spaces 112 therebetween and operative to provide electrical isolation of the segments 110.

In the present embodiment, both the inner and outer electrodes 101, 102 are substantially concentric and hollow. In particular, the inner and outer electrodes 101, 102 are substantially hollow cylinders. However, this is intended to be merely illustrative. Alternatively, substrates 108 and 109 could have a greater thickness for structural reasons, or electrical reasons, or both. Moreover, the thickness of the substrate 109 could be selected so that the inner electrode 102 is substantially solid.

In the embodiments described herein, the geometric shapes/sections of the electrodes 101, 102 are substantially cylindrical. However, the electrodes 101, 102 may also be other than cylindrical, albeit concentric. In yet other embodiments, non-concentric electrodes are contemplated. As will be appreciated, the selection of the geometry and structure (e.g., solid or hollow, and the thickness of the substrates 108, 109) depends on the desired electric field pattern desired, and other factors such as field strength.

In representative embodiments, the cylindrical electrodes are useful in generating a substantially quadro-logarithmic electrical potential in a region 113 between the inner and outer electrodes 101, 102, for use in a mass spectrometer. As described more fully in connection with FIGS. 2A-6, the potential distribution in region 113 is a function of the axial (z) and radial (r) position of the cylindrical coordinate system shown in FIG. 1B.

In the representative embodiments, the substrates 108, 109 comprise dielectric material(s) selected for desired electrical and mechanical properties, and processing amenability. The segments 103, 110 comprise electrically conductive material selected for its electrical properties as well as its amenability to processing. In representative embodiments, the segments are substantially the same width and thickness. Moreover, the segments 103, 110 are illustratively equally spaced. It is emphasized that this is merely illustrative and that segments of differing dimensions and spacing are contemplated.

Illustratively, the substrates 108, 109 may be FR4, or suitable plastic, or a composite material, or a semiconductor material or other dielectric material(s) suitable for the selected application. The conductive segments 103, 110 may be stainless steel, aluminum copper or Cu—Ni, or other alloy. Alternatively, or additionally, the segments may be made of other metal alloys or conductive composites. The segments may be machined, plated, or lithographically produced by methods known to one of ordinary skill in the art. Again, the selection of the material for the segments is application driven in many cases; and other materials are contemplated. Moreover, on the sides of the respective substrates 108, 109 opposite to the segments 103, 110, printed circuits can be manufactured. Similarly, passive and active electrical components, such as resistors, capacitors and preamplifiers, may be mounted over the substrates 108, 109 or formed therefrom. For example, mounting electrical components over an outer surface of the outer electrode 101; or over an inner surface of the (hollow) inner electrode 102; or both is contemplated. Among other benefits, the mounting of components to the substrates 108, 109 facilitates ready access thereto as well as tuning of the electrodes 101, 102.

Figure 2A:
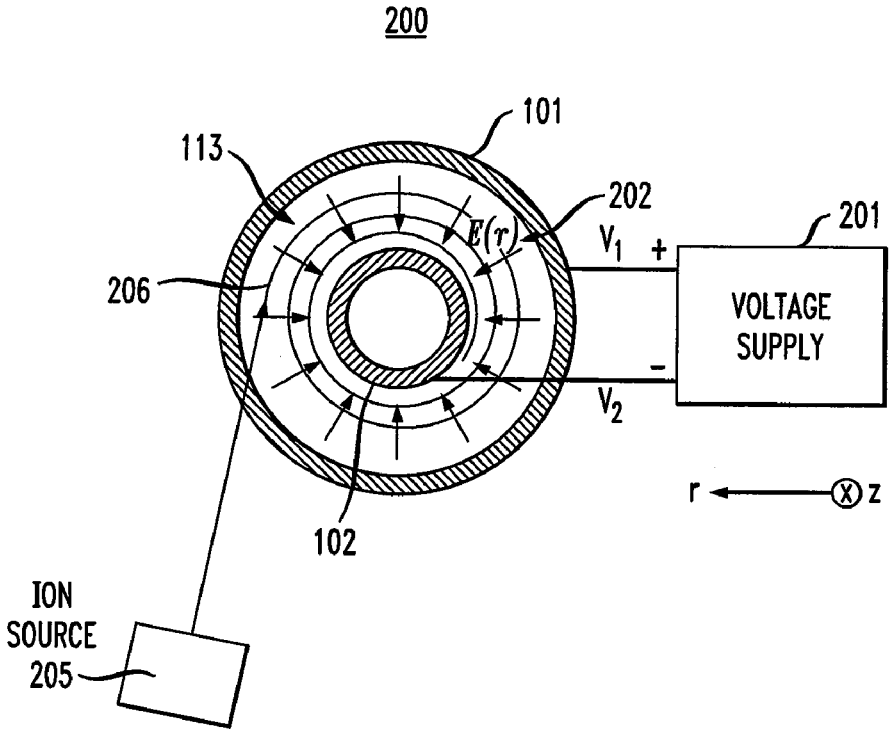
FIG. 2A is a conceptual view showing the electric field lines and ion trajectory in a mass spectrometer in accordance with representative embodiment.
Figure 2B:
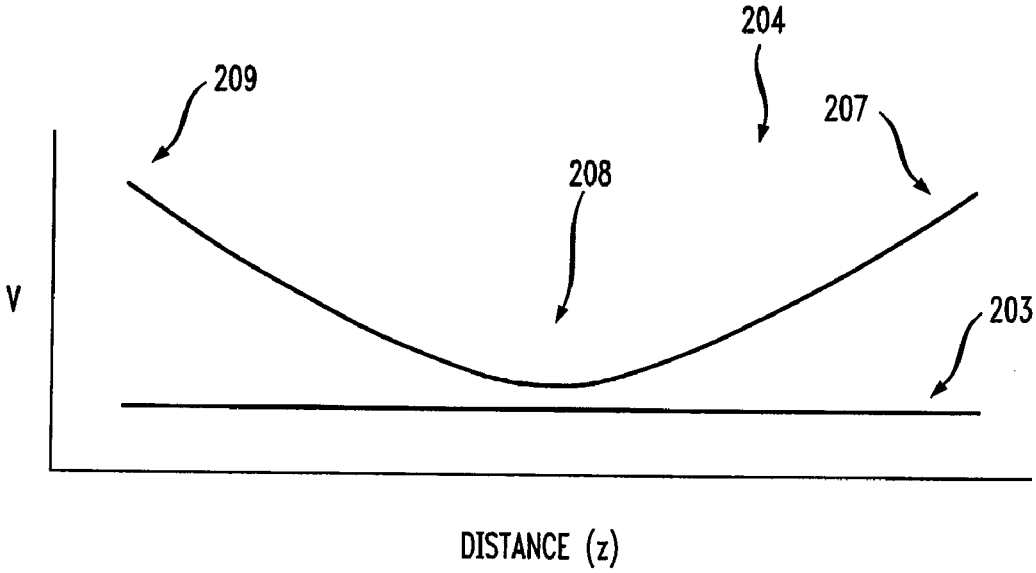
FIG. 2B is a graphical representation of an electrical potential generated by an electric field source for a mass spectrometer in accordance with representative embodiment.

FIG. 2A is a conceptual view showing the electric field lines and ion trajectory in a mass spectrometer 200 in accordance with representative embodiment. FIG. 2B is a graphical representation of a substantially quadro-logarithmic electrical potential versus distance along the length (z-direction of the coordinate system of FIG. 2A) of an electric field source for the mass spectrometer 200 in accordance with representative embodiment. Many of the details provided in the description of electric field source 100 are common to the mass spectrometer 200 and are not repeated to avoid obscuring the description of the present embodiment.

In a representative embodiment, a voltage supply 201 is connected to the central segment (not shown in FIG. 2A) of the inner and outer electrodes 101, 102 to generate a base potential difference $V_b$ in the region 113 between the electrodes 101, 102. Due to this potential difference, a radial field $E_r$ 202 is established. Further, passive electrical elements (e.g., resistors, not shown) are provided between the source 201 and the respective segments and are chosen so when voltages ($V_1$ and $V_2$) are applied to the passive elements, a certain voltage distribution is applied to each segment array. In combination with the base potential $V_b$ 203, a substantially quadro-logarithmic potential distribution 204 is created between two cylinders and along the z-direction. As described more fully herein, alternative techniques to generating a desired potential distribution (substantially quadro-logarithmic or other application-specific potential distribution) are contemplated, including but not limited to, providing a multi-channel digital-to-analog (DAC) for the voltage source.

As noted previously, at any point between two the electrodes 101, 102, the substantially quadro-logarithmic electrical potential is a function of its radial and axial coordinate (r, z). Quantitatively, the potential distribution is derived from Maxwell's equations and is given by:

$$\Phi(r, z) = \frac{k}{2}\left(z^2 - \frac{r^3}{2}\right) + \frac{k}{2}R_m^2 \ln\left(\frac{r}{R_m}\right) + C,$$

where k is a parameter describes the curvature of the electrical field, $R_m$ is characterized by the geometrical dimension of the electrodes 101, 102 (i.e., the radius of the cylinders in the present embodiment), and C is a constant of integration.

In a representative embodiment, the voltages applied to the segments ($V_1$ and $V_2$) are turned off before and during ion injection into the device so only the base potential $V_b$ 203 is applied to the electrodes 101, 102. Ions for spectroscopic analysis are provided by an ion source 205 and are introduced in the region 113 as shown. The ions follow a trajectory 206 under the influence of the electric field. Ions are sent into one end of the cylinders. Once the ions arrive in the field between the cylinders, voltages $V_1$ and $V_2$ are applied. The resulting potential distribution as given by the equation above is present.

In the radial direction, the electrical field is a radial (centripetal) field $E_r$ 202 with $$E_r = \frac{\partial}{\partial r}\Phi(r, z)$$

as shown in FIG. 2A. An ion with a tangential velocity, $V_r$, perpendicular to the cylinder axis will have a substantially circular motion around the inner cylinder. If the tangential (the so-called centrifugal) force and centripetal electrostatic force balanced, the motion is stable. On the other hand, the ions will also experience an axial (z-direction of the present coordinate system) acceleration force and move towards the (axial) central section of the region 113.

The ions are injected at one end of the electric field source of the mass spectrometer 200. As shown in FIG. 2 B, this end of the electric field source is commensurate with the point 207 of the electrical potential generated in the region 113 and are accelerated in the z-direction toward a central section of the electric field source that is commensurate with point 208 of the electrical potential distribution of FIG. 2B. After crossing a central section of the region 113, the ions continue to travel towards the far end of the electrodes of the electric field source and are decelerated due to the increment of the substantially quadro-logarithmic potential 204. The ions finally reverse the direction of their axial motion at the other end of the electrodes, which is commensurate with point 209 in FIG. 2B. As a result of the potential distribution over the axial length of region 113, the ions "shuttle" axially between two ends (i.e., axially between points 207 and 209 of the potential distribution) and are "trapped". Under the influence of the axial and radial components of the electric field in region 113, the motion of ions is similar to a spiral motion, with speed and rotational radius varying in the axial direction.

The motion of ions in the axial direction can be derived from:

$$m\frac{d^2}{dt^2}z = qE(z) \text{ or } \frac{d^2}{dt^2}z = -\frac{q}{n}kz$$

where m and q ion mass and charge respectively and E(z) is the axial field given by:

$$E(z) = -\frac{\partial}{\partial z}\Phi(r, z) = -kz.$$

The equation of motion in axial direction is in fact a harmonic oscillation expressed with:

$$z(t) = z_0\cos(\omega t) + \sqrt{2\frac{E(z=0)}{k}}\sin(\omega t)$$

$$\text{with } \omega = \sqrt{(q/m)\,k}$$

The radio frequency of the motion is a function of mass-to-charge ratio of an ion. Thus oscillation frequency depends on the mass-to-charge ratio. The dispersion of the initial ion energy does not affect the oscillation frequency. Precise Measuring the oscillation frequency of an ion yields its mass-to-charge ratio. Further details of orbitrap mass spectroscopy may be found in U.S. Pat. No. 6,872,938 to Makarov; and *Orbitrap Mass Analyzer—Overview and Applications in Proteomics*, Analytical Chemistry 2000, 72, 1156-1162, to Makarov, et al. The disclosures of the referenced patent and journal article are specifically incorporated herein by reference.

Figure 3:
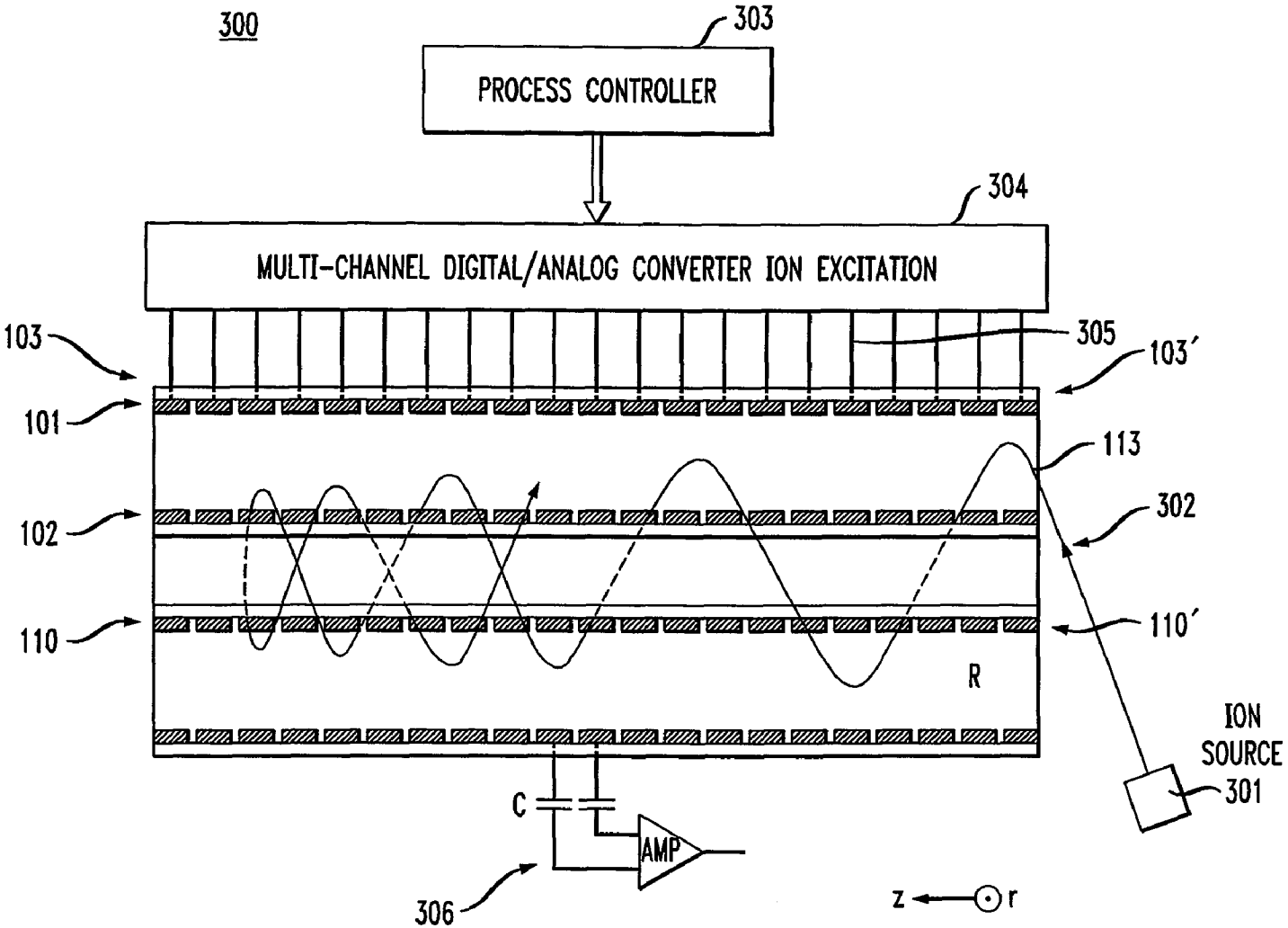
FIG. 3 is a simplified schematic view of a mass spectrometer in accordance with representative embodiment.

FIG. 3 is a simplified schematic view of a mass spectrometer 300 in accordance with representative embodiment.

Many of the details provided in the description of electric field source 100 and the mass spectrometer 200 are common to the mass spectrometer 300, and are not repeated to avoid obscuring the description of the present embodiment.

The mass spectrometer 300 includes an ion source 301, which injects ions 302 for mass analysis into the region 113 between the electrodes 101, 102, and into the substantially quadro-logarithmic potential established in region 113. As will be appreciated by one of ordinary skill in the art, the substantially quadro-logarithmic potential is greater at the ends (i.e., with respect to the axial or z-direction of the coordinate system shown) of the region 113, and thus at the location of injection of ions 302. As such, in order to facilitate the introduction of the ions 302 into the region 113, one or more segments 103', or one or more segments 110', or both, in a region toward an end or opening between the electrodes 101, 102 may be set to a lower voltage or may have no voltage applied thereto. Alternatively, in other embodiments, an aperture between segments 103, 103' may be provided and the ions injected in a direction substantially perpendicular to the axial direction of the outer electrode 101. In addition to the aperture, the segments 103, 103' can have a lower voltage or no voltage applied facilitating the ion injection. Still alternatively, the aperture may be provided through a segment 103, 103' directly. Again, the segments 103, 103' can have a lower voltage or no voltage applied facilitating the ion injection.

The mass spectrometer 300 also includes a process controller 303, which may be implemented in hardware, software or firmware, or a combination thereof. The controller 303 is connected to a multi-channel digital-to-analog converter (DAC) 304. The DAC 304 is connected to the outer electrode via connections 305; and may be connected to the inner electrode by similar connections (not shown) in order to generate the desired electric field/potential distribution in region 113. In another representative embodiment, the segments 110, 110' may be connected to ground or other potential via the DAC 304 or other voltage source in order to generate the desired potential distribution between the electrodes 101, 102. Still alternatively, the segments 110, 110' may be connected to the DAC 304 with voltages selectively applied thereto; and the segments 103, 103' may be connected to ground or other potential via the DAC 304 or other voltage source in order to generate the desired potential distribution.

Regardless of the selected method of ion injection, the mass spectrometers of the present teachings provide a number of clear benefits to ion injection compared to other known mass-spectrometer, and particularly known orbitrap-based spectrometers. One significant benefit is that ion optics and other comparatively elaborate ion injection apparatuses are not needed to introduce the ions 302 into the region; rather a comparatively simple selection of voltage to segments 103', 110', or providing openings in the outer electrode 101, or both, allows for injection of ions for mass spectroscopy.

Another significant benefit of the present teachings is the tunability of the electric field source. In many instances, there is a need to alter the output of the electrodes 101, 102. This need may arise from the need to refine the electric field generated, or to otherwise alter the output of the electrodes. As will be appreciated by one of ordinary skill in the art, this tunability may be effected via the controller or by selectively altering the passive components (e.g., resistors) to tune the electric field source as desired.

The controller 303 provides digital signals to the DAC 304 in order to generate a desired potential distribution in the region 113. The DAC 304 converts these digital signals into analog signals of the appropriate magnitude and provides the analog signals to the segments of the electrodes 101, 102. As such, based on the inputs from the controller 303, the DAC 304 generates a desired voltage distribution in the region 113 via the segments 103, 110, 103', 110'. As will be understood by one skilled in the art, a non-zero output impedance at the DAC 304 is required to provide a voltage output at the segments 103, 110, 103', 110'. In an illustrative embodiment, comparatively high output impedance at the DAC 304 is provided via passive electrical circuit elements (not shown).

As noted, inputs to the controller 303 ultimately result in the desired electric field in the region 113. The inputs may be determined empirically and modified as needed to generate the desired field; or may be determined from simulations, or both. Moreover, the inputs may be modified real-time as needed to establish and maintain a desired electric field in region 113. Illustratively, the inputs may be provided via a graphic user interface (GUI) that provides flexibility to alter the magnitude and shape of the potential distribution/electric field in the region 113. Moreover, the inputs to the controller 303 also govern the segments 103, 103', 110 and 110' selected to provide a voltage and the magnitude of the voltage at each segment. For example, the selection of the segments 103', 110' and the voltage applied to each to improve ion injection may be effected via inputs (e.g., through a GUI) to the controller 303.

The DAC 304 beneficially provides significant flexibility in the output potential distribution in region 113. In particular, because the DAC 304 is programmed to selectively apply voltages to segments 103, 103', 110, 110', substantially quadro-logarithmic potential needed for ion trapping and mass analysis. This unit may also include a radio frequency generator. A radio frequency waveform may be needed for ion excitation in some application. Segments of both the inner and outer cylinders can be controlled by the converter. In other embodiment, only part of the segments is directly controlled by the converter.

In operation, ions 302 traverse the region 113 under the influence of the electric field and along a trapped orbit described previously. Mass analysis is effected by one or more known methods. Illustratively, a preamplifier 306 is connected to two adjacent segments on the outer electrodes via two isolation capacitors. Transients of the image current induced at the segments 110 are recorded. Through a Fourier-Transformation, the transient signal can be displayed in a frequency domain. Oscillation frequencies, and consequently, mass-to-charge ratios of different ions species are determined by known methods. In another representative embodiment, signals from additional segments may be provided to the preamplifier 306 or other preamplifiers (not shown) to provide a more accurate spectra, such as by providing a better signal to noise ratio (SNR).

Figure 4A:
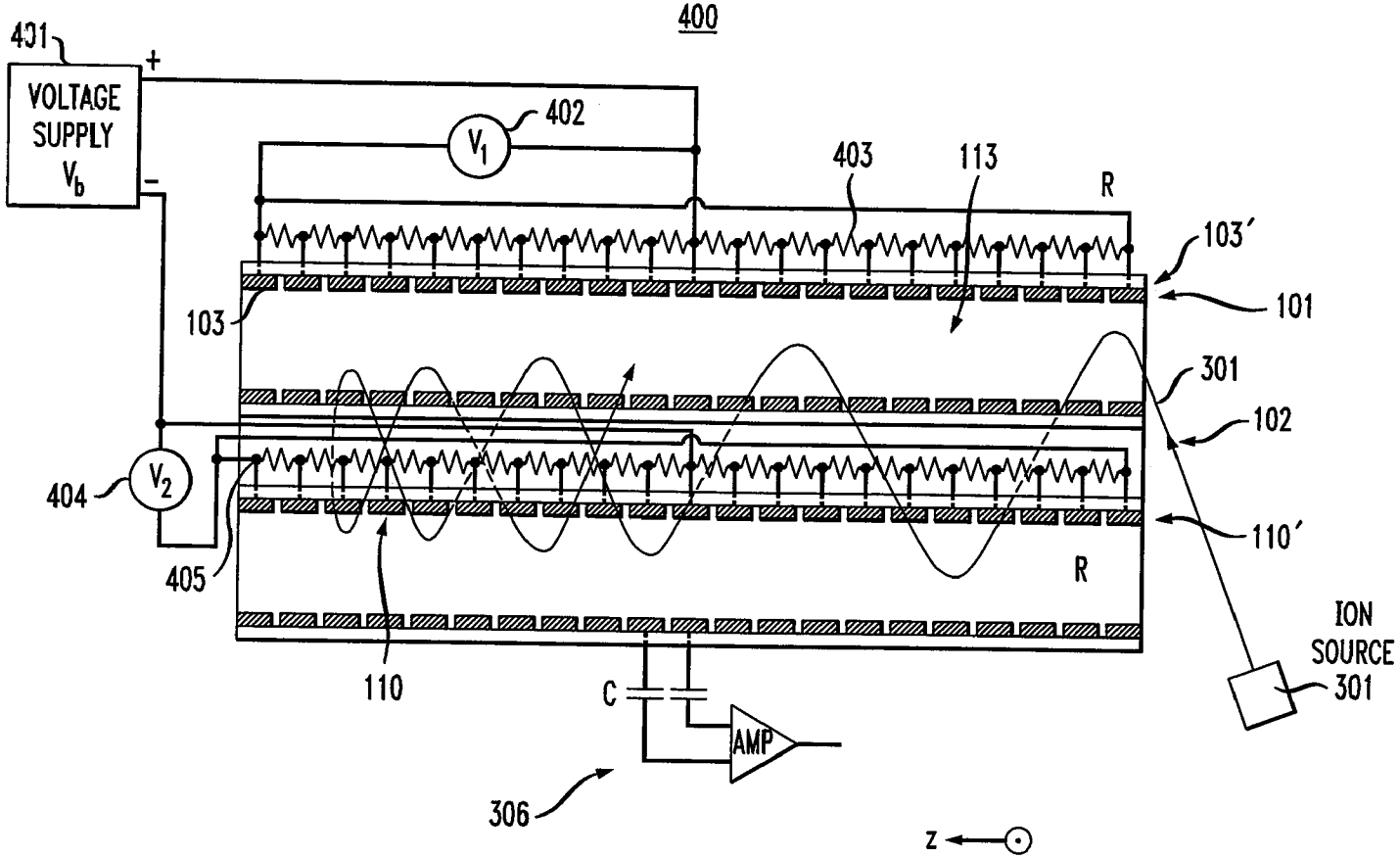
FIG. 4A is a simplified schematic view of a mass spectrometer in accordance with a representative embodiment.

FIG. 4A is a simplified schematic view of a mass spectrometer 400 in accordance with a representative embodiment. Many of the details provided in the description of electric field source 100 and the mass spectrometers 200, 300 are common to the mass spectrometer 400, and are not repeated to avoid obscuring the description of the present embodiment.

The mass spectrometer 400 includes the inner and outer electrodes 101, 102, the ion source 301 and the preamplifier 306 to provide the spectrometric function described previously. The spectrometer 400 also includes a voltage source 401, which provides voltage $V_1$ 402 directly to a central segment of the outer electrode 101 and voltage $V_2$ 404 directly to a central segment of the inner electrode. As described previously, this provides a baseline voltage. Moreover, and as shown, a plurality of resistors 403 connect the segments 103, 103' to $V_1$ 402 and a plurality of resistors 405 connect segments 110, 110' to the $V_2$ 404.

In a representative embodiment, the voltages $V_1$, $V_2$ and the magnitudes of the resistors 403, 405 are selected to generate the desired voltage at each segment 103, 103', 110, 110' to provide the desired electrical potential distribution/electric field in the region 113 between the electrodes 101, 102. For example, the values may be determined empirically, or by simulations, or both to generate a substantially quadro-logarithmic potential; and to provide the requisite magnitude thereof. Moreover, the voltages at segments 103', 110' for facilitating the injection of ions may also be determined empirically, or by simulations, or both, to avoid the need for elaborate ion optics or other elaborate ion injection equipment.

Illustratively, the preamplifier 306 is connected to two adjacent segments on the outer electrodes via two isolation capacitors. Transients of the image current induced at the segments 103 are recorded. Through a Fourier-Transformation, the transient signal can be displayed in a frequency domain. Oscillation frequencies, and consequently, mass-to-charge ratios of different ions species are determined by known methods. In another representative embodiment, signals from additional segments 103 may be provided to the preamplifier 306 or other preamplifiers (not shown) to provide a more accurate spectra, such as by providing a better signal to noise ratio (SNR).

Figure 4B:
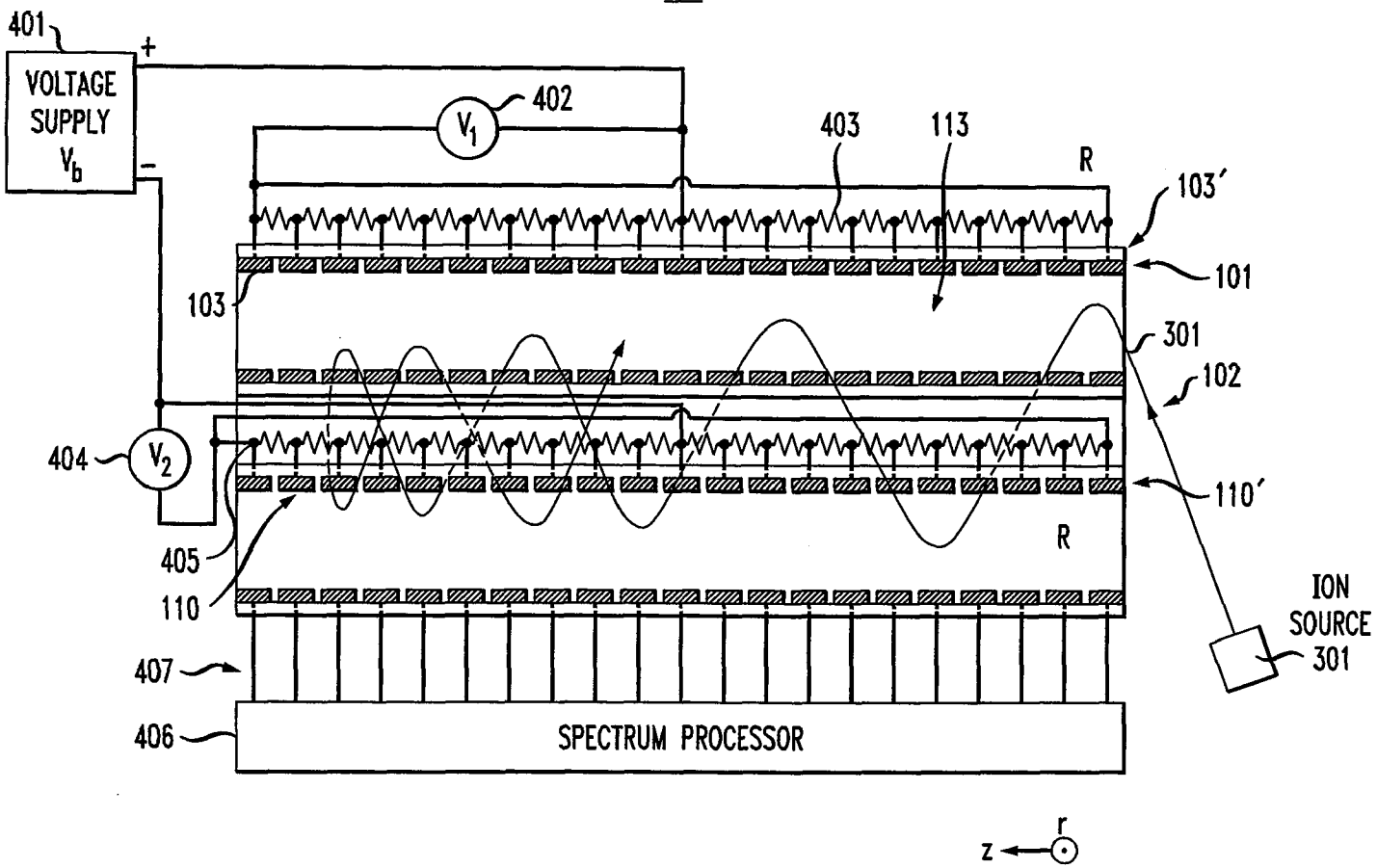
FIG. 4B is a simplified schematic view of a mass spectrometer in accordance with a representative embodiment.

FIG. 4B is a simplified schematic view of the mass spectrometer 400 in accordance with another representative embodiment. Many of the details provided in the description of electric field source 100 and the mass spectrometers 200, 300 and in the description of FIG. 4A are common to the mass spectrometer described in connection with FIG. 4B, and are not repeated to avoid obscuring the description of the present embodiment.

In the present embodiment, a spectrum processor 406 is provided to provide signal detection at more than one of the segments 103, 103'. Illustratively, a plurality of connections 407 is provided between the spectrum processor 406 and the segments 103, 103'. The spectrum processor 406 includes detectors (not shown) and amplifiers useful in garnering image current signals from the segments 103, 103'. The signals are combined and processed (e.g., filtered) to provide a mass spectrum for analysis of the ions of a sample injected. Beneficially, by providing selective signals, or a larger sampling of signals, or both, the signal strength and SNR may be improved and the validity of the data can be bolstered. By contrast, known obitrap spectrometers are limited to garnering samples from one point on the trap.

The connections 407 of the representative embodiment are shown in a one-to-one relationship, although fewer connections may be used. Regardless, the detection of image currents may be effected selectively by garnering signals selectively from the connections 407 at the spectrum processor. For example, it may be determined experimentally that garnering signals from alternate segments 103 provides suitable signal strength. Alternatively, signals may be garnered from alternating groups of sequential segments 103, with signals from intermediate segment(s) 103 not being provided to the spectrum processor. As will be appreciated, modifications to the pick-up of image currents from selected segments to meet a particular need will become apparent to one skilled in the art upon review of the present disclosure. As such, the arrangements described are intended to illustrate and not limit the breadth of application of the present teachings. Moreover, while not shown explicitly in FIG. 4A, connection of the spectrum processor 406 to the segments 110, 110' of the inner electrode 102 is contemplated. These connections may be selective to certain segments such as described relative to connections 407.

Figure 5:
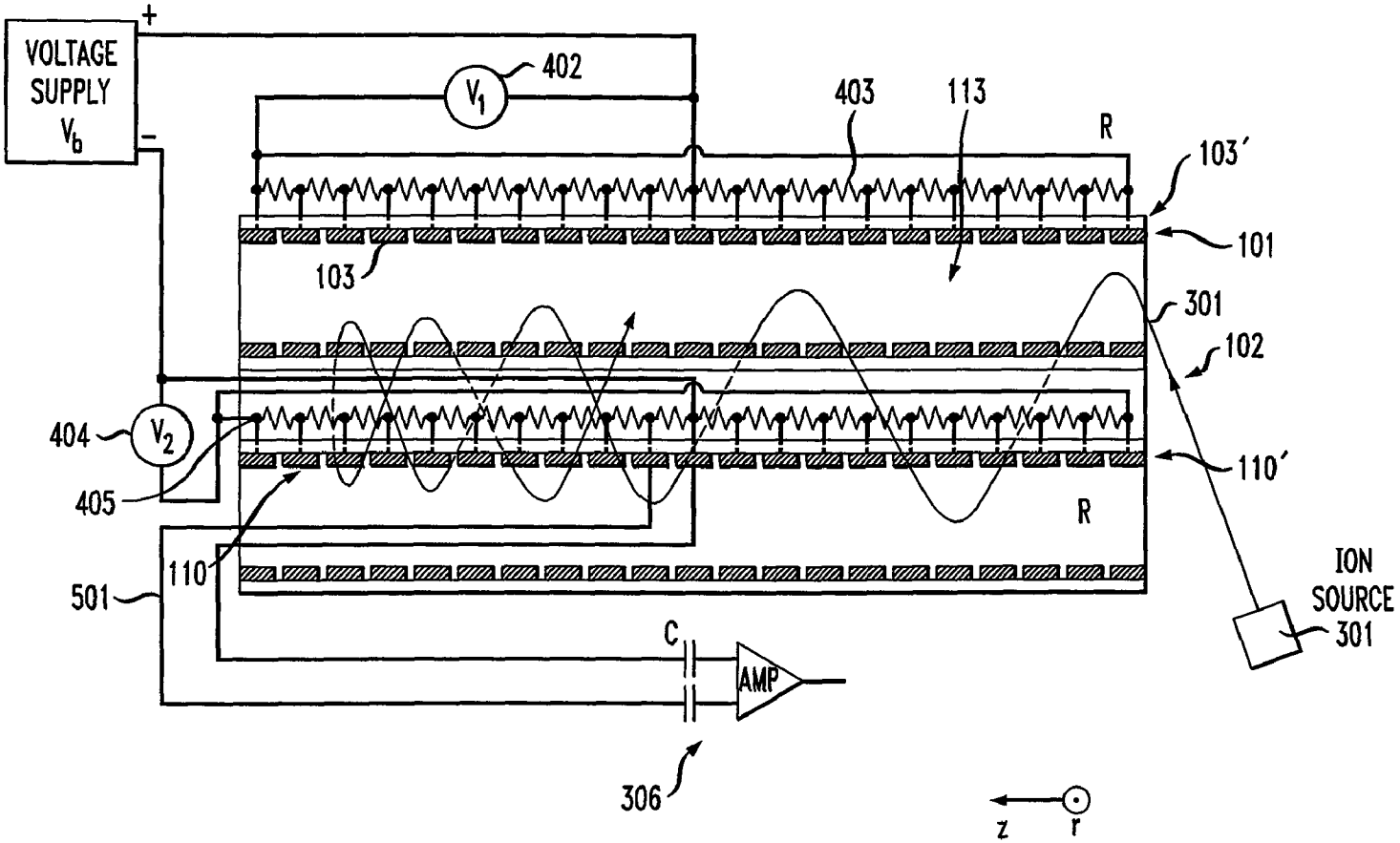
FIG. 5 is a simplified schematic view of a mass spectrometer in accordance with a representative embodiment.

FIG. 5 is a simplified schematic view of the mass spectrometer 500 in accordance with another representative embodiment. Many of the details provided in the description of electric field source 100 and the mass spectrometers 200, 300 and 400 are common to the mass spectrometer 500, and are not repeated to avoid obscuring the description of the present embodiment.

The structure and function of the mass spectrometer 500 is substantially identical to mass spectrometer 400 of FIG. 4A, excepting the collection of image current signals. To this end, rather than collecting signals from the outer electrode 101, the signals are collected from the inner electrode 102. Illustratively, a preamplifier 501 is connected to two adjacent segments 110 on the inner electrodes via two isolation capacitors. Transients of the image current induced at the segments 110 are recorded. Through a Fourier-Transformation, the transient signal can be displayed in a frequency domain. Oscillation frequencies, and consequently, mass-to-charge ratios of different ions species are determined by known methods. In another representative embodiment, signals from additional segments may be provided to the preamplifier 501 or other preamplifiers (not shown) to provide a more accurate spectra, such as by providing a better signal to noise ratio (SNR).

Figure 6:
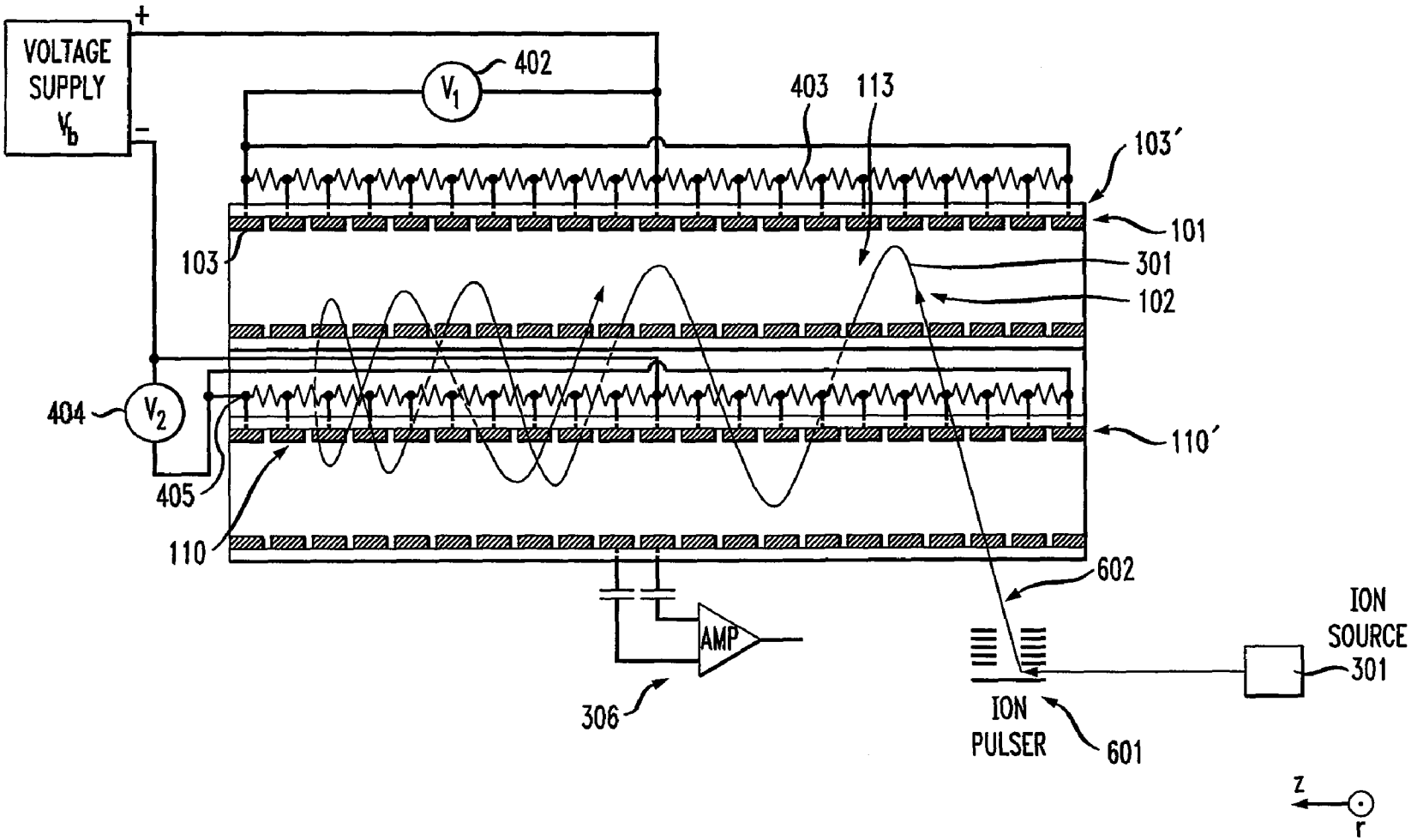
FIG. 6 is a simplified schematic view of a mass spectrometer in accordance with a representative embodiment.

FIG. 6 is a simplified schematic view of a mass spectrometer 600 in accordance with another representative embodiment. Many of the details provided in the description of electric field source 100 and the mass spectrometers 200, 300, 400, 500 are common to the mass spectrometer 600, and are not repeated to avoid obscuring the description of the present embodiment.

The mass spectrometer 600 includes an ion pulser 601 that receives ions from ion source 301 and injects pulses of ions into the region 113 via an aperture 602 in one of the segments 103. Notably, the pulsed ions may be introduced through an opening in the substrate 110 between two segments 103 and in a direction in a direction more parallel to the cylinder axis. In the pulser 601, ions are accelerated by an electrical pulse in the direction orthogonal to the initial ion path. The use of a pulser fosters a more even distribution of ion kinetic energies and thus reduces dispersion due to the spread in the frequency of oscillation.

In view of this disclosure it is noted that the various resonator apparatuses and ferromagnetic resonance filters described herein can be implemented in a variety of materials and variant structures. Moreover, applications other than ferromagnetic resonance filters may benefit from the present teachings. Further, the various materials, structures and parameters are included by way of example only and not in any limiting sense. In view of this disclosure, those skilled in the art can implement the present teachings in determining their own applications and needed materials and equipment to implement these applications, while remaining within the scope of the appended claims.

The invention claimed is:

1. An electric field source for use in a mass spectrometer, the electric field source comprising:

a substantially cylindrical inner electrode, comprising electrically-isolated conductive segments arranged in tandem, and a substantially cylindrical substrate, wherein the substantially cylindrical substrate is substantially hollow;

a substantially cylindrical outer electrode concentric with the inner electrode, the outer electrode comprising electrically-isolated conductive segments arranged in tandem; and a voltage source connected to the outer electrode and operative to apply a pattern of voltages to the conductive segments.

2. A electric source as claimed in claim 1, wherein the pattern of voltages applied to the conductive segments creates a substantially quadro-logarithmic electrical potential between the inner and outer electrodes.

3. An electric field source as claimed in claim 1, wherein the inner electrode and the outer electrode are both substantially cylindrical.

4. An electric field source as claimed in claim 1, further comprising a passive electrical component connected between the voltage source and a respective conductive segment of the outer electrode.

5. An electric field source as claimed in claim 1, wherein the voltage source is connected to the inner electrode is additionally connected to the conductive segments of the inner electrode and is operative to apply a pattern of voltages to the conductive segments of the inner electrode.

6. An electric field source as claimed in claim 1, wherein the voltage source comprises a multi-channel digital-to-analog converter.

7. An electric field source as claimed in claim 1, additionally comprising a substantially cylindrical insulating substrate supporting the conductive segments of the outer electrode.

8. An electric field source as claimed in claim 1, additionally comprising a substantially cylindrical insulating substrate supporting the conductive segments of the inner electrode.

9. A mass spectrometer adapted to dynamically traps ions in an electrostatic field, comprising:

a substantially cylindrical inner electrode, comprising electrically-isolated conductive segments arranged in tandem, and a substantially cylindrical substrate, wherein the substantially cylindrical substrate is substantially hollow;

a substantially cylindrical outer electrode concentric with the inner electrode, the outer electrode comprising electrically-isolated conductive segments arranged in tandem; and a voltage source connected to the outer electrode and operative to apply a pattern of voltages to the conductive segments;

a spectrum processor adapted to receive signals from at least one of the plurality of conductive segments.

10. A mass spectrometer as claimed in claim 9, wherein the selectively applied voltage creates a substantially quadro-logarithmic electrical potential between the inner and outer electrodes.

11. A mass spectrometer as claimed in claim 9, wherein the inner electrode and the outer electrode are both substantially cylindrical.

12. A mass spectrometer as claimed in claim 9, further comprising a passive electrical component connected between the voltage source and a respective conductive segment of the outer electrode.

13. A mass spectrometer as claimed in claim 9, wherein the voltage source is connected to the inner electrode is additionally connected to the conductive segments of the inner electrode and is operative to apply a pattern of voltages to the conductive segments of the inner electrode.

14. A mass spectrometer as claimed in claim 9, wherein the voltage source comprises a multi-channel digital-to-analog converter.

15. A mass spectrometer as claimed in claim 9, additionally comprising a substantially cylindrical insulating substrate supporting the conductive segments of the outer electrode.

16. A mass spectrometer as claimed in claim 9, additionally comprising a substantially cylindrical insulating substrate supporting the conductive segments of the inner electrode.

17. A mass spectrometer as claimed in claim 9, further comprising an amplifier connected to at least one of the plurality of conductive segments of the outer electrode and to the spectrum processor.

18. A mass spectrometer as claimed in claim 17, wherein the spectrum processor comprises a Fourier Transform spectrum processor.

19. An electric field source for use in a mass spectrometer, the electric field source comprising:

a substantially cylindrical inner electrode, comprising electrically-isolated conductive segments arranged in tandem, and a substantially cylindrical substrate, wherein the substantially cylindrical substrate is substantially hollow;

a substantially cylindrical outer electrode concentric with the inner electrode, the outer electrode comprising electrically-isolated conductive segments arranged in tandem; and a voltage source connected to the outer electrode, or to the inner electrode, or both, and operative to apply a pattern of voltages to the conductive segments of the inner electrode, or the outer electrode, or both.

20. A mass spectrometer as claimed in claim 19, additionally comprising a substantially cylindrical insulating substrate supporting the conductive segments of the outer electrode.

21. A mass spectrometer as claimed in claim 19, additionally comprising a substantially cylindrical insulating substrate supporting the conductive segments of the inner electrode.

* * * * *

UNITED STATES PATENT AND TRADEMARK OFFICE

CERTIFICATE OF CORRECTION

PATENT NO. : 7,755,040 B2
APPLICATION NO. : 11/860263
DATED : July 13, 2010
INVENTOR(S) : Gangqiang Li et al.

It is certified that error appears in the above-identified patent and that said Letters Patent is hereby corrected as shown below:

In column 11, line 8, in Claim 2, delete "A electric source" and insert -- An electric field source --, therefor.

Signed and Sealed this

Twenty-sixth Day of October, 2010

David J. Kappos

David J. Kappos
*Director of the United States Patent and Trademark Office*